US011267603B2

(12) United States Patent
Dong et al.

(10) Patent No.: US 11,267,603 B2
(45) Date of Patent: Mar. 8, 2022

(54) ELECTRONIC TAG IMPLANTATION DEVICE

(71) Applicants: QINGDAO HIGHWAY IOT TECHNOLOGY CO., LTD., Qingdao (CN); MESNAC CO., LTD., Qingdao (CN)

(72) Inventors: Lanfei Dong, Qingdao (CN); Luxin Wang, Qingdao (CN); Haijun Chen, Qingdao (CN); Haibo Qi, Qingdao (CN); Qiang Tong, Qingdao (CN)

(73) Assignees: QINGDAO HIGHWAY IOT TECHNOLOGY CO., LTD., Qingdao (CN); MESNAC CO., LTD., Qingdao (CN)

( * ) Notice: Subject to any disclaimer, the term of this patent is extended or adjusted under 35 U.S.C. 154(b) by 0 days.

(21) Appl. No.: 16/770,570

(22) PCT Filed: Mar. 22, 2018

(86) PCT No.: PCT/CN2018/080052
§ 371 (c)(1),
(2) Date: Jun. 5, 2020

(87) PCT Pub. No.: WO2019/109544
PCT Pub. Date: Jun. 13, 2019

(65) Prior Publication Data

US 2020/0369426 A1 Nov. 26, 2020

(30) Foreign Application Priority Data

Dec. 8, 2017 (CN) ..... 201711294246.4

(51) Int. Cl.
*B65C 9/18* (2006.01)
*B65C 1/02* (2006.01)
(Continued)

(52) U.S. Cl.
CPC ..... *B65C 9/1865* (2013.01); *B65C 1/021* (2013.01); *B65C 9/0006* (2013.01);
(Continued)

(58) Field of Classification Search
CPC ..... B65C 1/021; B65C 9/0006; B65C 9/0015; B65C 9/1865; B65C 9/36; B65C 9/40;
(Continued)

(56) References Cited

FOREIGN PATENT DOCUMENTS

| | | |
|---|---|---|
| CN | 202807213 | 3/2013 |
| CN | 106516316 | 3/2017 |

(Continued)

OTHER PUBLICATIONS

Translation of IDS reference CN106516316A, Mar. 22, 2017, Dongguan Huabei Electroni (Year: 2017).*

*Primary Examiner* — George R Koch
(74) *Attorney, Agent, or Firm* — Jiwen Chen; Jacobson Holman PLLC

(57) ABSTRACT

Disclosed by the present invention is a device for embedding electronic tag, which comprises: a tag separating unit configured to separate an electronic tag from a base film; a tag conveying unit configured to transmit the electronic tag to a setting position; and a tag grasping placing unit configured to grasp and attach an electronic tag. As an electronic tag being implanted on a product, firstly separating the electronic tag to be placed from the base film thereon by the tag separating unit, then grasping the separated electronic tag by the tag grasping placing unit, then transmitting the tag grasping placing unit to a setting position by the conveying unit, then attaching the electronic tag on the device by the tag grasping placing unit, that means the completion of the entire process of placement. During which, the actions of separating, grabbing, transmitting and placing are all realized automatically. In comparison with manual work, the
(Continued)

present invention could not only improve production efficiency, but also reduce the risks of omission and misplacement, thereby improving the product quality.

7 Claims, 3 Drawing Sheets

(51) Int. Cl.
*B65C 9/00* (2006.01)
*B65C 9/36* (2006.01)
*B65C 9/42* (2006.01)

(52) U.S. Cl.
CPC ..... *B65C 9/0015* (2013.01); *B65C 9/36* (2013.01); *B65C 9/42* (2013.01); *B65C 2009/0003* (2013.01); *B65C 2009/0018* (2013.01)

(58) Field of Classification Search
CPC ..... B65C 9/42; B65C 2009/0003; B65C 2009/0018; B65C 2009/005
See application file for complete search history.

(56) References Cited

FOREIGN PATENT DOCUMENTS

| | | |
|---|---|---|
| JP | 2005335775 | 12/2005 |
| KR | 20140089966 | 7/2014 |

* cited by examiner

ELECTRONIC TAG IMPLANTATION DEVICE

This is a U.S. national stage application of PCT Application No. PCT/CN2018/080052 under 35 U.S.C. 371, filed Mar. 22, 2018 in Chinese, claiming priority to Chinese Patent Application No. 201711294246.4, filed Dec. 8, 2017, all of which are hereby incorporated by reference.

TECHNICAL FIELD

The present invention relates to the technical field of tire production, and in particular to a device for embedding electronic tag.

BACKGROUND TECHNOLOGY

In traditional tire tread production, vulcanized electronic label served as the only information provider to track identification as the tire being circulated. As the concept of intelligent manufacturing being advanced and the automation applications growing in tire industry, RFID (Radio Frequency Identification) electronic tag will be widely used in near future.

These days, the implantation of electronic tag in tire mainly relies on the manual work of placement, which not only consumes more time resulting in low efficiency, but also causes risks of omission or misplacement. Additionally, the manual work could not ensure unified position of each of the electronic tag being placed, which also have negative impact on product quality directly or indirectly.

Hence, how to design an embedding device for electronic tag that could not only improve production efficiency, but also reduce the risks of omission or misplacement, and further improve the product quality, is an urgent technical problem should be solved by skilled person in the art.

SUMMARY OF THE INVENTION

Disclosed is a device for embedding electronic tag, which is not only improve production efficiency, but also reduce the risks of omission or misplacement, and further improve the product quality.

A device for embedding electronic tag comprises:

a tag separating unit configured to separate an electronic tag from a base film;

a tag conveying unit configured to transmit the electronic tag to a setting position; and a tag grasping placing unit configured to grasp and attach an electronic tag.

Preferably, the tag separating unit includes a tag plate on which the electronic tag and base film are being placed by wrapping, a base film reel around which the electronic tag and the base film are being wrapped, and a tag separating mechanism configured to separate the electronic tag from the base film.

Preferably, the device for embedding electronic tag further comprises a first driving device configured to drive the base film reel.

Preferably, the device for embedding electronic tag further comprises a guiding roller passing the electronic tag and the base film.

Preferably, the device for embedding electronic tag further comprises a photoelectric sensor configured to detect the electronic tag.

Preferably, the tag conveying unit comprises a second driving device, a synchronous pulley connected to the second driving device and a synchronous belt connected to the synchronous pulley which is provided with cantilevers.

Preferably, the second driving device is a motor.

Preferably, the number of the cantilevers is in the range of 1 to 3.

Preferably, the tag grasping placing unit comprises a gripping jaw cylinder, a gripping pressing cylinder connected to the gripping jaw cylinder and a placing cylinder connected to the gripping pressing cylinder, the gripping jaw cylinder is provided with a gripping jaw at the bottom.

Preferably, the device for embedding electronic tag further comprises a pressure regulating valve configured to adjust the pressure of the gripping jaw cylinder, the gripping pressing cylinder and the placing cylinder.

It could be seen from the above technical solutions that the device for embedding electronic tag disclosed by the present invention comprises device for embedding electronic tag comprises: a tag separating unit configured to separate an electronic tag from a base film; a tag conveying unit configured to transmit the electronic tag to a setting position; and a tag grasping placing unit configured to grasp and attach an electronic tag. As an electronic tag being implanted on a product, firstly separating the electronic tag to be placed from the base film thereon by the tag separating unit, then grasping the separated electronic tag by the tag grasping placing unit, then transmitting the tag grasping placing unit to a setting position by the conveying unit, then attaching the electronic tag on the device by the tag grasping placing unit, that means the completion of the entire process of placement. During which, the actions of separating, grabbing, transmitting and placing are all realized automatically. In comparison with manual work, the present invention could not only improve production efficiency, but also reduce the risks of omission and misplacement, thereby improving the product quality.

BRIEF DESCRIPTION OF THE DRAWINGS

For the purpose of promoting and understanding of the principles of the invention, reference will now be made to the drawings used in illustrating embodiments or background of the invention. It will nevertheless be understood that no limitation of the scope of the invention is thereby intended. Any alterations and further modifications in the drawings would normally occur to one skilled in the art to which the invention relates.

In which:

1—tag separating unit, 11—tag plate, 12—base film reel, 13—tag separating mechanism, 14—first driving device, 15—guiding roller, 16—photoelectric sensor, 2—tag conveying unit, 21—second driving device, 22—synchronous pulley, 23—synchronous belt, 24—cantilever, 3—tag grasping placing unit, 31—gripping jaw cylinder, 311—gripping jaw, 32—gripping pressing cylinder, 33—placing cylinder, 34—pressure regulating valve.

DETAILED DESCRIPTION

In view of this, disclosed by the present invention is focus on a device for embedding electronic tag, which not only could improve production efficiency, but also could reduce the risk of omission or misplacement, thereby improving the production quality effectively.

The present invention will be further described in detail below with reference to the drawings and specific embodiments in order to provide a better understanding.

As shown in FIG. 1 to FIG. 5, a device for embedding electronic tag comprises a tag separating unit 1 configured to separate an electronic tag from a base film; a tag conveying unit 2 configured to transmit the electronic tag to a setting position; a tag grasping placing unit 3 configured to grasp and attach an electronic tag. As an electronic tag being implanted on a product, firstly separating the electronic tag to be placed from base film thereon by the tag separating unit 1, then grasping the separated electronic tag by the tag grasping placing unit 3, then transmitting the tag grasping placing unit 3 to a setting position by the conveying unit 2, then attaching the electronic tag on the device by the tag grasping placing unit 3, that means the completion of the entire process of placement. During which, the actions of separating, grabbing, transmitting and placing are all realized automatically. In comparison with manual work, the present invention could not only improve production efficiency, but also reduce the risks of omission and misplacement, thereby improving the product quality.

Figure 1:
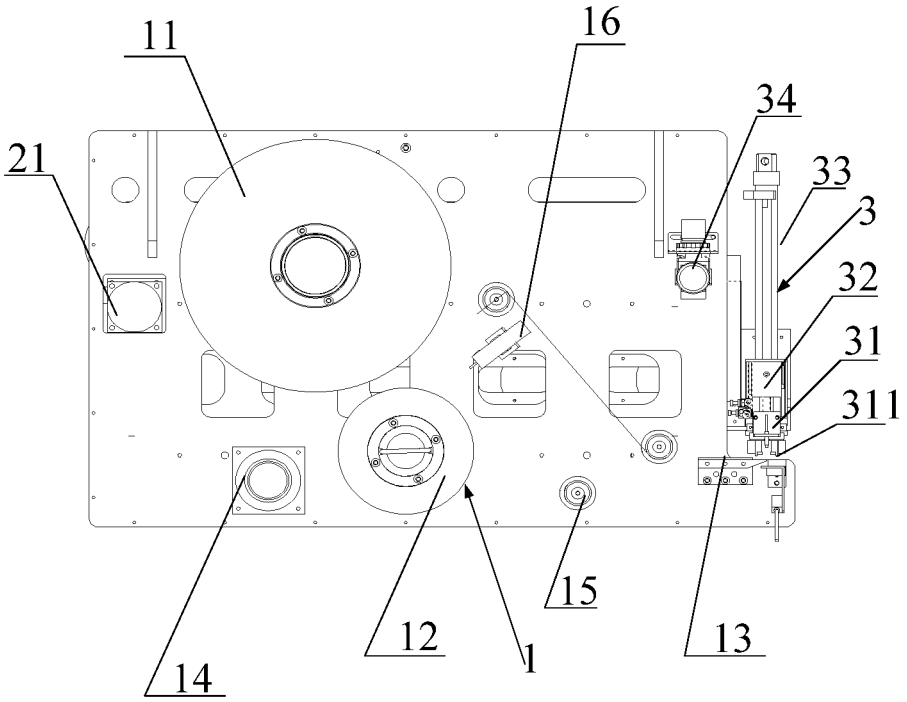
FIG. 1 is a schematic front view showing a tag separating unit and a tag grasping placing unit according to an embodiment of the present invention.
Figure 2:
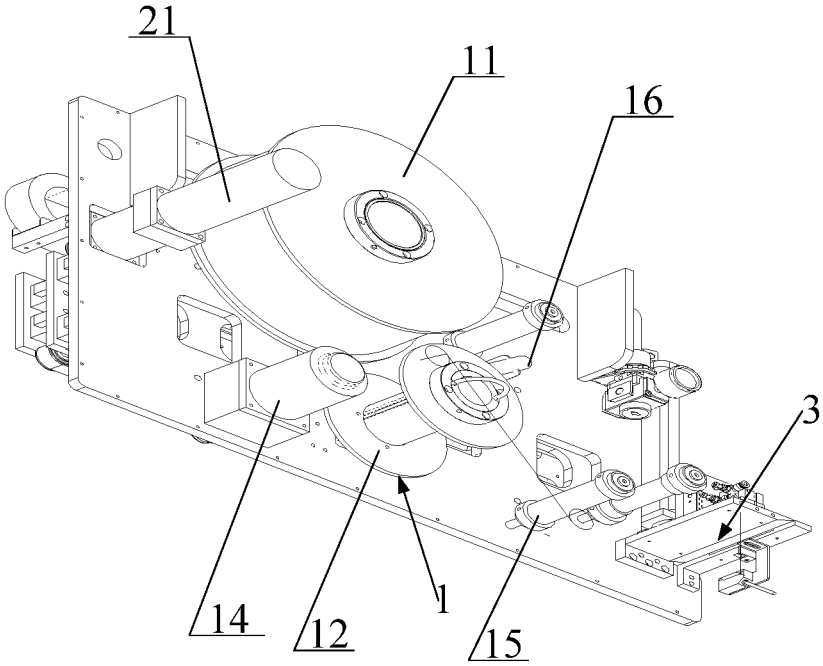
FIG. 2 is a schematic view showing the overall structure of a tag separating unit and a tag grasping placing unit according to an embodiment of the present invention.

Referring to FIG. 1, the tag separating unit 1 disclosed in the embodiment of the present invention includes a tag plate 11 on which the electronic tag and base film are being placed by wrapping, a base film reel 12 around which the electronic tag and the base film are being wrapped, and a tag separating mechanism 13 configured to separate the electronic tag from the base film.

It should be noted that the tag plate 11 is disposed on a mounting shaft, and the tag plate 11 is rotatable about the mounting shaft.

One end of the electronic tag and the base film is fixed to the tag plate 11, and the other end is connected to the tag separating mechanism 13 through the base film reel 12. The electronic tag and the base film which are placed on the tag plate 11 are moving to wrap around the base film reel 12 as the base film reel 11 rotating. Since both of the electronic tag and the base film are connected to the tag separating mechanism 13, the electronic tag is separated from the base film, thereby realizing the separation of the electronic tag.

It should be further noted that the base film reel 12 could be rotated manually or automatically. In the embodiment of the present invention, in order to further improve the production efficiency, the base film reel 12 is preferably driven to rotate automatically. Hence, the device for embedding electronic tag disclosed by the embodiment of the present invention further comprises a first driving device 14 for driving the base film reel 12. When the first driving device 14 is being activated, the base film reel 12 is being driven by the first driving device 14 to rotate; when the first driving device 14 is switched off, the base film reel 12 stops correspondingly; the first driving device 14 may be a hydraulic motor or a motor.

Further, the device for embedding electric tag further includes a guiding roller 15 passing and supporting the electronic tag and the base film, which configured to effectively guide the transmission of the electronic tag and the base film between the tag plate 11 and the base film reel 12, and between the base film reel 12 and the separating mechanism 13.

Further, in order to detect whether the electric tag is left over on the base film and prevent the failure of separation from occurring, the device for embedding electric tag further comprises a photoelectric sensor 16 configured to detect whether the electric tag is left over on the base film.

Figure 3:
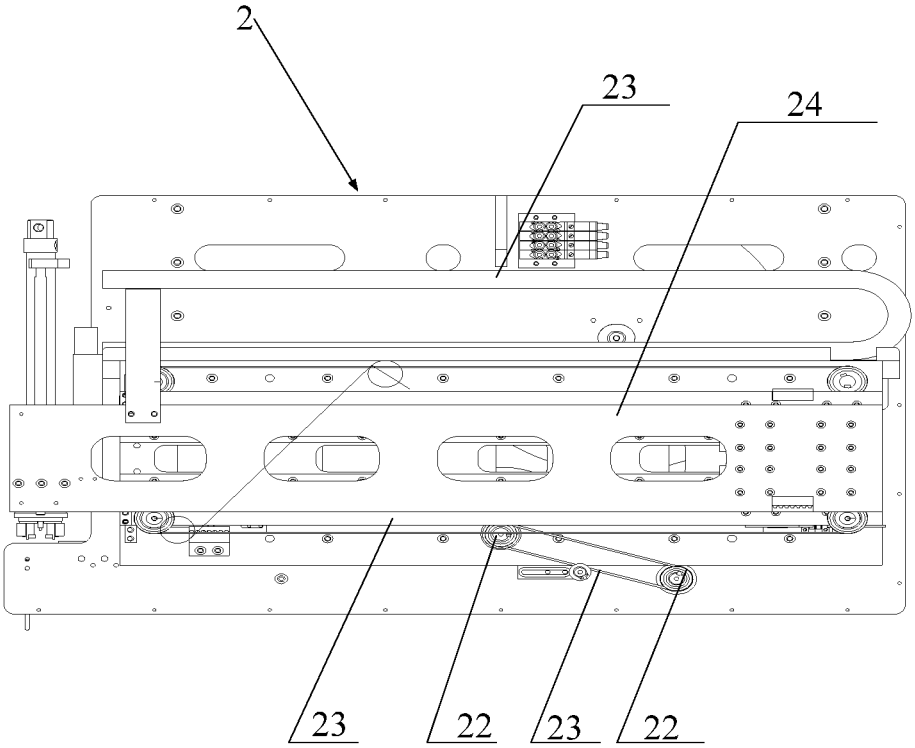
FIG. 3 is a front view showing the structure of a tag conveying unit according to an embodiment of the present invention.
Figure 4:
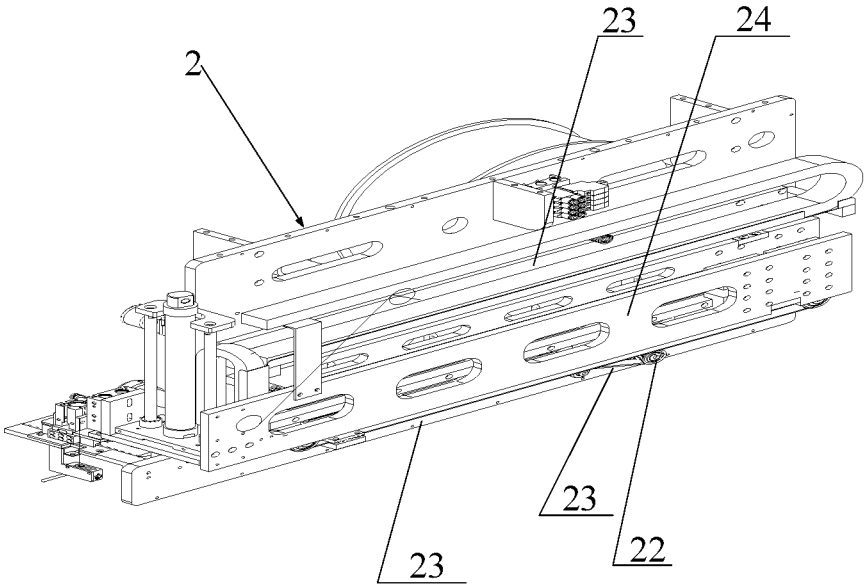
FIG. 4 is a schematic overall structural view of a tag conveying unit according to an embodiment of the present invention.

Referring to FIG. 3, in the device for embedding electronic tag disclosed by the present invention, the tag conveying unit comprises a second driving device 21 and a synchronous pulley 22 connected to the second driving device 21. The synchronous pulley 22 further connects to a synchronous belt 23, wherein the synchronous belt 23 is provided with cantilevers 24. As the electronic tag being grasped by the tag grasping placing unit 3, the tag grasping placing unit 3 is being transmitted by the tag conveying unit 2 to the setting position where the cantilevers 24 extend out or retract so as to move and locate the electronic tag between a grasp position and a placement position.

It should be noted that the second driving device could be a motor or a hydraulic motor, wherein the motor is preferable due to its features of being simple in structure and easy to install.

The number of the cantilevers 24 could be in the range of 1 to 3. Practically, the length of the extension depends on the number of the cantilevers. In this embodiment preferably two cantilevers are provided so as to move and locate the electronic tag between a grasp position and a placement position effectively.

Figure 5:
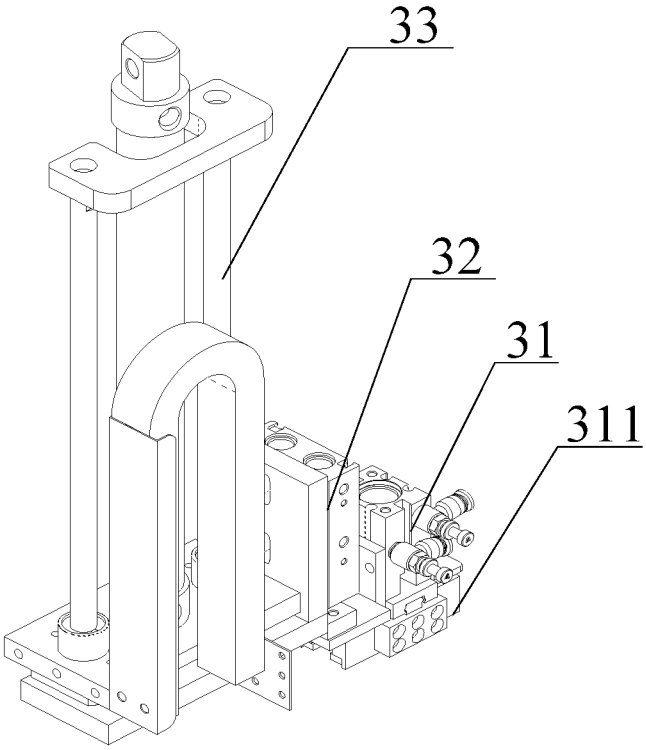
FIG. 5 is a schematic structural view of a tag grasping placing unit according to an embodiment of the present invention.

Referring to FIG. 5, in the device for embedding electronic tag disclosed by the embodiment of the present invention, the tag grasping placing unit 3 comprises a gripping jaw cylinder 31, a gripping pressing cylinder 32 connected to the gripping jaw cylinder 31, and a placing cylinder 33 connected to the gripping pressing cylinder 32, wherein gripping jaws 311 are provided at the bottom of the gripping jaw cylinder 31. As the electronic tag being separated, the gripping pressing cylinder 32 is driven to extend out to press the gripping jaw cylinder 31 so as to enable the gripping jaws 311 to be close to the electronic tag. As the electronic tag being close to the gripping jaws, the gripping jaw cylinder 31 extends out to clamp the electronic tag, and then the gripping pressing cylinder 32 retracts to complete the action of clamp. Then the tag grasping placing unit 3 is being transmitted by the tag conveying unit 2 to a setting position. When the electronic tag reaches to the setting position, the placing cylinder 33 extends out to press the gripping pressing cylinder 32. The gripping jaw cylinder 31 is being pressed by the gripping pressing cylinder 32 and the gripping jaw 311 attaches the electronic tag onto the product. As the electronic tag completely being placed onto the product, the gripping jaw 311 is being released and the placing cylinder 33 retracts, the overall process for electronic tag placement is completed.

It should be noted that the device for embedding electronic tag disclosed by the embodiment according to the present invention further includes a pressure regulating valve 34 configured to adjust the pressure of the gripping jay cylinder 31, the gripping pressing cylinder 32 and the placing cylinder. Proper pressure of the cylinders could further ensure the quality of electronic tag placement.

It is to be further noted that the tag separating unit 1, the tag conveying unit 2, and the tag grasping placing unit 3 are all disposed on the mounting substrate.

The various embodiments in the present specification are described in a progressive manner, and each embodiment focuses on differences from other embodiments, and the same similar parts between the various embodiments may be referred to each other.

While the invention has been illustrated and described in detail in the drawings and foregoing description with respect to a device for embedding electronic tag, the same is to be considered as illustrative and not restrictive in character, it being understood that only the preferred embodiment has been shown and described and that all equivalents, changes and modifications that come within the spirit of the inventions as described herein and/or by the following claims are desired to be protected.

What is claimed is:

1. A device for embedding electronic tag in a tire comprises:

a tag separating unit configured to separate an electronic tag from a base film;

a tag conveying unit configured to transmit the electronic tag to a setting position; and a tag grasping placing unit configured to grasp and attach the electronic tag;

wherein the tag conveying unit comprises a second driving device, a synchronous pulley connected to the second driving device and a synchronous belt connected to the synchronous pulley which is provided with at least one cantilever;

wherein the number of the cantilevers is in the range of 1 to 3;

wherein the tag grasping placing unit comprises a gripping jaw cylinder, a gripping pressing cylinder connected to the gripping jaw cylinder and a placing cylinder connected to the gripping pressing cylinder, wherein the gripping jaw cylinder is provided with a gripping jaw at the bottom; and wherein the device further comprises a pressure regulating valve configured to adjust the pressure of the gripping jaw cylinder, the gripping pressing cylinder and the placing cylinder.

2. The device for embedding electronic tag in a tire according to claim 1, wherein the tag separating unit includes a tag plate on which the electronic tag and base film are being placed by wrapping, a base film reel around which the electronic tag and the base film are being wrapped, and a tag separating mechanism configured to separate the electronic tag from the base film.

3. The device for embedding electronic tag in a tire according to the claim 2 further comprising a first driving device configured to drive the base film reel.

4. The device for embedding electronic tag in a tire according to the claim 1 further comprising a guiding roller passing the electronic tag and the base film.

5. The device for embedding electronic tag in a tire according to the claim 1 further comprising a photoelectric sensor configured to detect the electronic tag.

6. The device for embedding electronic tag in a tire according to claim 1, wherein the second driving device is motor.

7. A device for embedding electronic tag in a tire comprises:

a tag separating unit configured to separate an electronic tag from a base film;

a tag conveying unit configured to transmit the electronic tag to a setting position; and a tag grasping placing unit configured to grasp and attach the electronic tag;

wherein the tag conveying unit comprises a second driving device, a synchronous pulley connected to the second driving device and a synchronous belt connected to the synchronous pulley which is provided with at least one cantilever;

wherein the number of the cantilevers is in the range of 1 to 3;

wherein the tag grasping placing unit comprises a gripping jaw cylinder, a gripping pressing cylinder connected to the gripping jaw cylinder and a placing cylinder connected to the gripping pressing cylinder, wherein the gripping jaw cylinder is provided with a gripping jaw at the bottom;

wherein the device further comprises a pressure regulating valve configured to adjust the pressure of the gripping jaw cylinder, the gripping pressing cylinder and the placing cylinder;

wherein the tag separating unit includes a tag plate on which the electronic tag and base film are being placed by wrapping, a base film reel around which the electronic tag and the base film are being wrapped, and a tag separating mechanism configured to separate the electronic tag from the base film;

wherein the device further comprises a first driving device configured to drive the base film reel;

wherein the device further comprises a guiding roller passing the electronic tag and the base film;

wherein the device further comprises a photoelectric sensor configured to detect the electronic tag; and wherein the second driving device is motor.

* * * * *